United States Patent [19]

Okada

[11] Patent Number: 4,721,307

[45] Date of Patent: Jan. 26, 1988

[54] SLOT MACHINE

[75] Inventor: Kazuo Okada, Tokyo, Japan

[73] Assignee: Kabushiki Kaisha Universal, Tochigi, Japan

[21] Appl. No.: 27,185

[22] Filed: Mar. 17, 1987

[30] Foreign Application Priority Data

Mar. 17, 1986 [JP] Japan ..... 61-37609[U]

[51] Int. Cl.[4] ..... A63F 5/04

[52] U.S. Cl. ..... 273/143 R

[58] Field of Search ..... 273/143, 138 A

[56] References Cited

U.S. PATENT DOCUMENTS 4,676,506 6/1987 Crouch ..... 273/143 R

FOREIGN PATENT DOCUMENTS 58488 8/1982 European Pat. Off. ..... 273/138 A
65404 11/1982 European Pat. Off. ..... 273/138 A
2911710 10/1980 Fed. Rep. of Germany ... 273/143 R
2083936 3/1982 United Kingdom ..... 273/138 A
2106293 4/1983 United Kingdom ..... 273/138 A

OTHER PUBLICATIONS

Slot Machines of Yesteryear Operator's Companion Mills of the Forties, © 1980, pp. 182–183, Mills, "Wild Device Bell".

*Primary Examiner*—Paul E. Shapiro
*Attorney, Agent, or Firm*—Young & Thompson

[57] ABSTRACT

A slot machine having a plurality of symbol series disposed side by side and movable lengthwise independently, selects a combination of symbols on a winning line which is judged as to whether it coincides with any one of the predetermined prize-winning symbol combinations to pay out a predetermined number of coins. At least one of the symbol series includes a special mark as distinguished from the symbols. When the slot machine selects any one of the predetermined prize-winning symbol combinations, and one of the symbols of this combination is replaced with the special mark, the slot machine pays out coins as a special dividend the number of which is larger than that of coins to be paid out upon the one predetermined prize-winning symbol combination.

5 Claims, 4 Drawing Figures

SLOT MACHINE

BACKGROUND OF THE INVENTION

The present invention relates to a slot machine which selects combinations of symbols on winning lines, and more particularly to a slot machine which pays a special dividend when a prize-winning symbol combination on a winning line includes a special mark.

In a slot machine of the type having a plurality of reels, for example three reels, disposed side by side, a game is started by suppling a start lever after a coin or coins are inserted to start the reels into rotation simultaneously. The reels are rotated for a certain time period and then stopped either at random or by operating a stop button to select a combination of symbols on the winning line which is played. When the combination of symbols is determined to be a predetermined prize-winning combination, coins are paid out, the number of which is determined in correspondence with the difficulty in obtaining the symbol combination.

A video-type slot machine which displays a plurality of series of symbols on a CRT screen can be played in basically much the same manner as the above-described slot machine and is also contemplated by the present invention.

In conventional slot machines, the prize-winning combinations are mostly sets of the same symbols. For instance, the slot machine can display on one winning line a big hit prize-winning combination such as a set of symbols "7" and a set of symbols "BAR" to pay out 15 coins as a high dividend, a middle hit prize-winning combination such as a set of cherry symbols, a set of watermelon symbols, or a set of plum sumbols to pay out 10 coins as a middle dividend, or a small hit prize-winning combination such as a combination of symbols including at least two cherry symbols or a combination of symbols including at least one cherry symbol to pay out five coins as a low dividend.

A problem in conventional slot machines is that games tend to become monotonous, particularly when repeatedly played.

OBJECT OF THE INVENTION

It is therefore an object of the present invention to provide a slot machine which can be played with more variety and which will thus better hold the interest of the player.

SUMMARY OF THE INVENTION

According to the present invention, a slot machine is provided which has at least one symbol series that includes a special mark. This special mark is distinguished from the symbols of the series and constitutes a special prize-winning combination only when one of the symbols of what would otherwise be a predetermined prize-wining combination is replaced by it. The special prize-winning combination allows a special dividend which is higher than the ordinary dividend for what would otherwise be the predetermined prize-winning combination.

According to a feature of the present invention, the special prize-winning combination comprises at least one special mark, the rest of th symbols being identical to each other.

BRIEF DESCRIPTION OF THE INVENTION

These and other objects and features of the present invention will become apparent from the following description taken in conjunction with preferred embodiments shown in the accompanying drawings, in which.

DETAILED DESCRIPTION OF THE INVENTION

Because slot machines are well known in the art, the present description will be directed in particular to elements forming part of, or cooperating more directly with, the present invention, slot machine elements not specifically shown or described herein being understood to be selectable from those known in the prior art.

Figure 1:
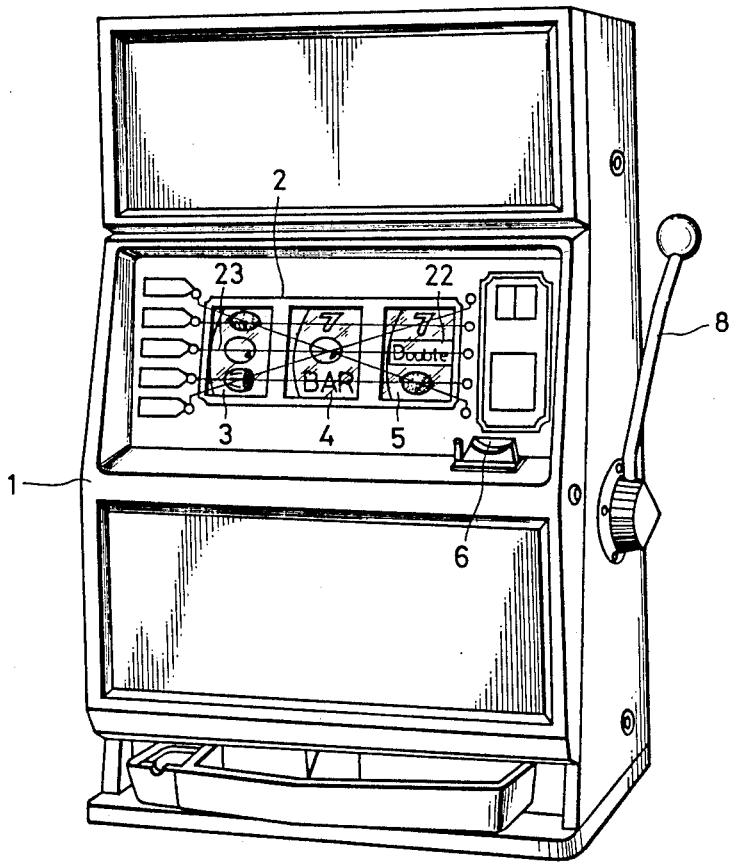
FIG. 1 is a perspective view showing illustratively one example of a slot machine according to the present invention.

Referring now to FIG. 1 showing a slot machine embodying the present invention, formed in the front panel of the main body 1 of the slot machine is a display window 2 covered by a transparent glass plate through which three symbols on each of the first to third reels 3 to 5 coaxially mounted in the main body 1 can be viewed. As is shown in FIG. 1, there are five winning lines, namely three horizontal and two oblique, visible through the glass. As is well known in the art, the winning lines are played by inserting a coin or coins (including tokens) into a coin slot prior to playing a game. The number of winning lines to be played is ordinarily determined depending on the number of inserted coins, which are counted by a coin detector 7 shown in FIG. 2.

Upon pulling a starting lever 8 after the insertion of playing coins, the game starts under the control of a micro-computer 10. The micro-computer 10 frequency-divides therein a train of pulses from a pulse generator 11 to provide driving pulses to stepping motors 13 to 15 connected with the reels 5 to 7 respectively, thereby starting the reels 3 to 5 into rotation simultaneously.

Driving pulses supplied to each of the stepping motors 13 to 15 are counted by counters (not shown) associated with the respective motors 13 to 15 in the micro-computer 10. On the periphery of each reel 3, 4, 5 is an axially projecting lug *3a, 4a, 5a* indicating a reference position thereof which can interrupt a photosensor 16, 17, 18 provided in association with each reel 3, 4, 5 to provide a reset signal every revolution of the reel, this reset signal being supplied to the counter and resetting it. As is well known, as the stepping motors 13 to 15 rotate through a given angle every driving pulse, the rotated angular position of each reel 3, 4, 5 during one revolution can be precisely determined based on the count of its associated counter. Moreover, since the symbols have a predetermined angular spacing, the identity of a symbol appearing on a winning line can be determined.

The micro-computer 10 shuts off the application of driving pulses to the stepping motors 13 to 15 with random timing, thereby to stop them, thus stopping the reels 3 to 5. At this time, the micro-computer 10 makes a determination of what combinations appear on the played lines based on the counted values in the counters. As a result of this decision, if in fact there is a prize-winning combination, a hopper 20 is actuated to pay out as many coins as the number which is predetermined in correspondence with the degree of difficulty in obtaining the combination. Thereupon the game is finished.

Figure 2:
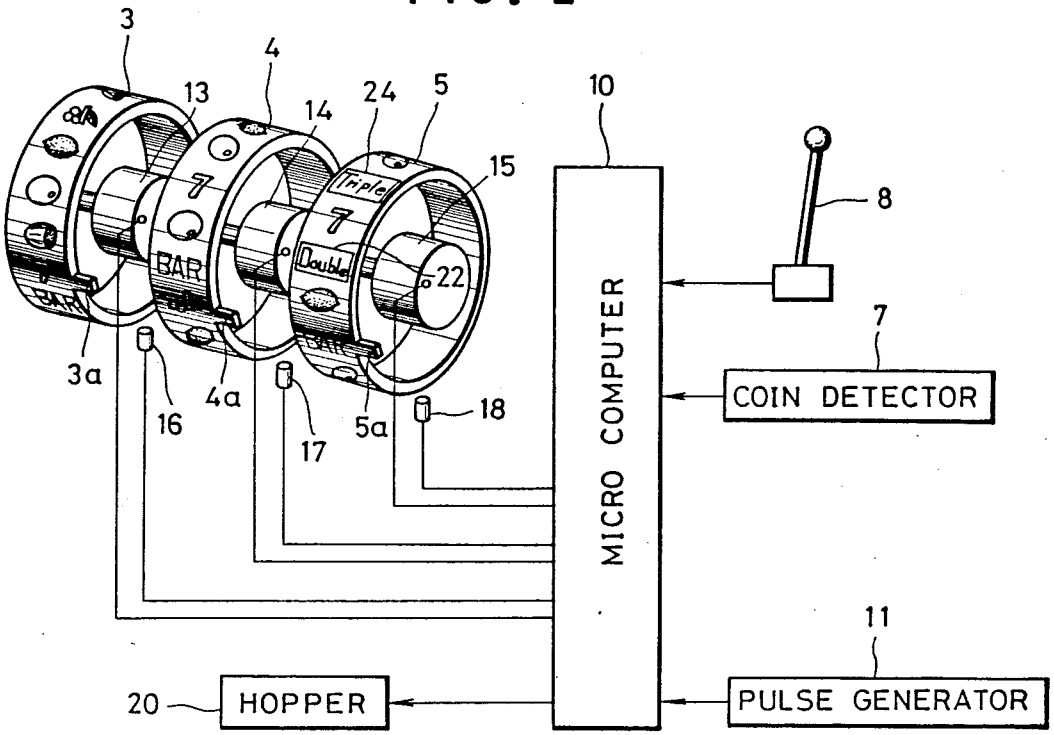
FIG. 2 is a block diagram showing a control circuit of the slot machine according to the present invention.

As is depicted in FIGS. 1 and 2, in accordance with this invention, there is a special mark 22 "Double" provided on the third reel 5. This special mark 22 is distinguished from ordinary symbols such as "7", "BAR", "orange", "plum" and "cherry" symbols. When the special mark 22 "Double" appears in place of one of the three members of a prize-winning combination of three identical symbols, the slot machine pays out coins as a special dividend of a number twice that for the three identical symbols, for example, triple "orange". More specifically, if the slot machine, which usually pays out, say, 10 coins when triple "orange" occurs, pays out 20 coins when the combination double "orange" plus special mark 22 "Double" occurs on the winning line 23. This special dividend is paid each time one of the symbols of any ordinary prize-winning combination is replaced with the special mark 22 "Double".

In addition, there is another special mark 24 "Triple" on the third reel 5. When one of symbols of any ordinary prize-winning combination is replaced with the special mark 24 "Triple", the dividend for the special combination is trebled compared to that for the ordinary prize-winning combinations.

Figure 3:
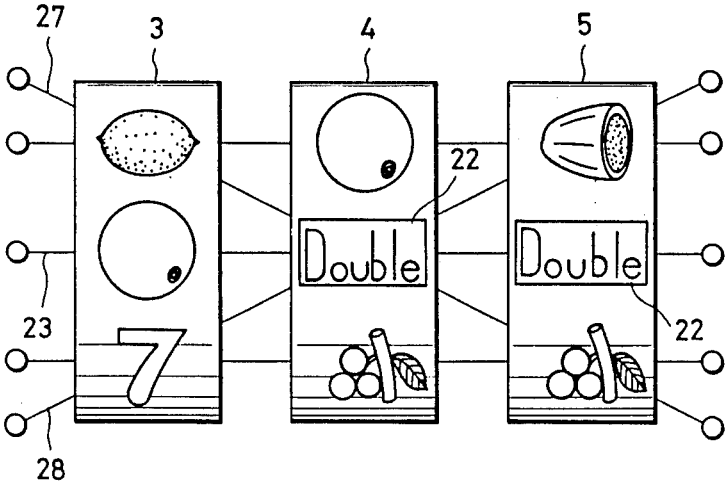
FIGS. 3 and 4 schematically show examples of what might appear in the reel window of FIG. 1.

FIG. 3 is an illustration of symbols in the display window 2 wherein another special mark 22 "Double" is on the second reel 4. As shown in FIG. 3, there is a combination of one orange symbol and two special marks "Double" on the winning line. This special combination is considered to be a special winning combination wherein two symbols of an ordinary prize-winning combination including an orange symbol are replaced with two special marks "Double". In this case, the dividend for the special combination is four times as much as for the ordinary prize-winning combination, i.e., three oranges. On the other hand, combinations of symbols occurring on the oblique winning lines 27 and 28 are not awarded a dividend, because combinations which are obtained by replacing the special mark 22 "Double" of the oblique combinations, with any symbol on the second reel 4, are not prize-winning ones.

Figure 4:
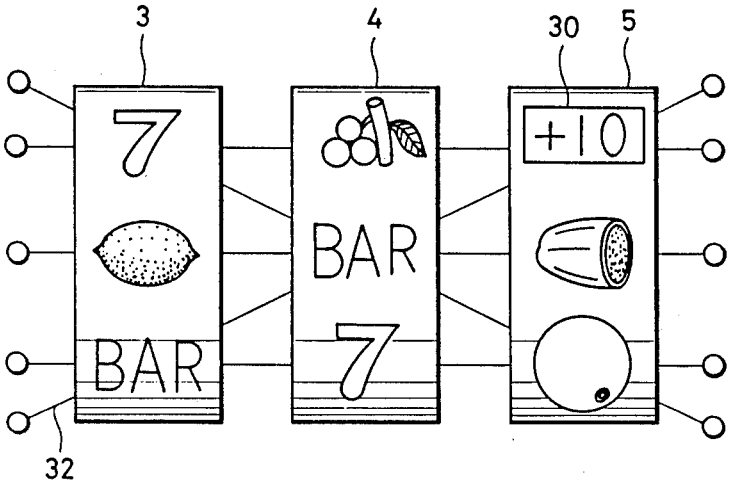

FIG. 4 illustrates symbols appearing in the display window, wherein a special figure mark 30 "+10" is provided on the third reel 5 in place of the special mark 22 "Double".

If the ordinary prize-winning combination of three "BAR" symbols occurring on any played line pays 15 coins as its dividend, the combination of two "BAR" symbols and the special mark 30 "+10" occurring on the played line allows an additional dividend of 10 coins, and so pays out 25 coins in all.

It is permissible to provide mixed multiple-dividend special marks such as "Double" and "Triple" and additional-dividend special marks such as "+10" and "+20".

Although the invention has been described as to particular embodiments thereof, it will be apparent to those skilled in the art that the invention is applicable to slot machines both of the type displaying selected combinations on a CRT screen and of the type wherein reels are controlled to stop to display a combination of symbols which is predetermined based on a sample random number.

What is claimed is:

1. In a slot machine having a plurality of symbol series which are disposed side by side and movable lengthwise independently, means for selecting combinations of symbols on winning lines in a display window, and means for paying out coins as dividends when said selected symbol combinations coincide with any one of a plurality of predetermined prize-winning symbol combinations; the improvement that at least one of said symbol series includes at least one special mark; and said coin pay-out means is adapted to pay out coins as a special dividend when there occurs on said winning line any one of said predetermined prize-winning symbol combinations at least one of whose symbols is replaced with said special mark.

2. A slot machine as defined in claim 1, wherein said predetermined prize-winning combination is a plurality of the same symbols.

3. A slot machine as defined in claim 1, wherein said special mark is a sign represented an arithmetical value.

4. A slot machine as defined in claim 3, wherein the number of coins paid as said special dividend is the number of coins paid out upon the occurrence of said one predetermined prize-winning symbol combination multiplied by said arithmetical value.

5. A slot machine as defined in claim 3, wherein the number of coins paid as said special dividend is the sum of the number of coins paid out upon the occurrence of said one predetermined prize-winning symbol combination and a number equal to said arithmetical value.

* * * * *